US011333439B2

(12) United States Patent
Nielsen et al.

(10) Patent No.: US 11,333,439 B2
(45) Date of Patent: May 17, 2022

(54) CENTRE BODY IN SPIRAL HEAT EXCHANGER

(71) Applicant: Danfoss A/S, Nordborg (DK)

(72) Inventors: Helge Nielsen, Sydals (DK); Jes Petersen, Kolding (DK)

(73) Assignee: Danfoss A/S, Nordborg (DK)

( * ) Notice: Subject to any disclaimer, the term of this patent is extended or adjusted under 35 U.S.C. 154(b) by 0 days.

(21) Appl. No.: 17/078,228

(22) Filed: Oct. 23, 2020

(65) Prior Publication Data

US 2021/0123682 A1 Apr. 29, 2021

(30) Foreign Application Priority Data

Oct. 25, 2019 (DK) ..... PA201901255

(51) Int. Cl.
*F28D 7/04* (2006.01)

(52) U.S. Cl.
CPC ..... *F28D 7/04* (2013.01)

(58) Field of Classification Search
CPC ..... F28D 7/02; F28D 7/022; F28D 7/024; F28D 7/026; F28D 7/04; F28D 9/04; F28D 9/0012
See application file for complete search history.

(56) References Cited

U.S. PATENT DOCUMENTS 705,614 A * 7/1902 Rogers ..... F28D 9/04 165/149
731,469 A * 6/1903 Pontois ..... F28F 1/128 165/152
1,110,065 A * 9/1914 Linga ..... F28F 7/02 165/164
1,383,408 A * 7/1921 Leister ..... F22B 27/165 122/261
1,945,287 A 1/1934 Monroe
2,060,440 A * 11/1936 Rosenblad ..... F28D 9/04 165/146
2,131,265 A * 9/1938 Bichowsky ..... B21D 53/027 165/165
2,209,577 A * 7/1940 Podbielniak ..... B04B 5/06 261/83

(Continued)

FOREIGN PATENT DOCUMENTS

AT 304596 B * 1/1973 ..... F28D 9/04
CA 2 701 518 A1 6/2009

(Continued)

OTHER PUBLICATIONS

AT-304596_English_machine_translation (Year: 1973).*
Extended European Search Report for European Patent Application No. 20201003 dated Feb. 5, 2021.

*Primary Examiner* — Jianying C Atkisson
*Assistant Examiner* — Jose O Class-Quinones
(74) *Attorney, Agent, or Firm* — McCormick, Paulding & Huber PLLC

(57) ABSTRACT

A spiral heat exchanger is formed of at least two sheets extending along a spiral-shaped path around a common centre body and separated to form at least a first and a second spiral-shaped substantially parallel flow channels extending and enabling flow communication between a radially outer orifice and a radially inner orifice. The centre body includes a wall body with a first conduit at the inner surface of the wall body being in fluid connection to the first flow channel, and a second conduit formed at the outer surface of the wall body and being in fluid connection to the second flow channel.

12 Claims, 3 Drawing Sheets

(56) References Cited

U.S. PATENT DOCUMENTS

| | | | | | |
|---|---|---|---|---|---|
| 2,360,739 | A * | 10/1944 | Strom | F28D 9/04 | 165/165 |
| 2,730,265 | A * | 1/1956 | Lundgren | F28D 7/08 | 220/623 |
| 4,124,069 | A | 11/1978 | Becker | | |
| 4,365,483 | A * | 12/1982 | Binger | F25B 39/04 | 165/104.19 |
| 4,445,566 | A * | 5/1984 | Laing | F28D 9/04 | 165/10 |
| 5,922,178 | A | 7/1999 | Isenberg | | |
| 6,607,027 | B2 * | 8/2003 | Bosch | F01M 5/00 | 165/163 |
| 7,640,972 | B2 * | 1/2010 | Maupetit | F28D 9/04 | 165/164 |
| 2007/0062680 | A1 * | 3/2007 | Maupetit | F28D 9/04 | 165/163 |
| 2015/0300745 | A1 * | 10/2015 | Kolb | F28D 7/022 | 165/156 |

FOREIGN PATENT DOCUMENTS

| | | | | |
|---|---|---|---|---|
| CN | 1409813 | A | 4/2003 | |
| CN | 1802547 | A | 7/2006 | |
| CN | 200989226 | Y | 12/2007 | |
| CN | 102782436 | A | 11/2012 | |
| CN | 206638070 | U | 11/2017 | |
| CN | 206683450 | U | 11/2017 | |
| CN | 108302964 | A | 7/2018 | |
| DE | 30 14 506 | A1 | 11/1980 | |
| GB | 466685 | A * | 6/1937 | F28D 9/04 |
| JP | 4002944 | B2 | 11/2007 | |
| RU | 2 451 890 | C2 | 5/2012 | |
| RU | 162 986 | U1 | 7/2016 | |
| RU | 165 577 | U1 | 10/2016 | |
| SU | 906395 | A3 | 2/1982 | |
| WO | 2004/102101 | A1 | 11/2004 | |
| WO | 2010/142749 | A1 | 12/2010 | |
| WO | 2014/085874 | A2 | 6/2014 | |

* cited by examiner

CENTRE BODY IN SPIRAL HEAT EXCHANGER

CROSS-REFERENCE TO RELATED APPLICATION

This application claims foreign priority benefits under 35 U.S.C. § 119 to Danish Patent Application No. PA201901255 filed on Oct. 25, 2019, the content of which is hereby incorporated by reference in its entirety.

BACKGROUND

The present invention refers a spiral heat exchanger where a first sheet and a second sheet are positioned spiralling around a common central axis extending in a length direction. The two sheets thus extend along a spiral-shaped path around said central axis forming parallel flow channels for respectively a first and second fluids, extending and enabling flow communication between a radially outer orifice and a radially inner orifice being in fluid communication with the either an inlet or outlet of each set of port connections. Respectively the radially inner orifice and outer orifice of the first flow channel thus is in fluid communication to an inlet and outlet of the first set of port connections, and second flow channel thus is in fluid communication to an inlet and outlet of the s set of port connections.

General problems with such spiral heat exchangers are precision in the rolling of the sheets in the spiralling configuration, the ability to endure high pressures, and the fluid connection at the centre of the spiral to and from the heat exchanger.

SUMMARY

The solution according to the present invention is as given in the claims.

This includes introducing a spiral heat exchanger formed of at least two sheets extending along a spiral-shaped path around a common centre body and separated to form at least a first and a second spiral-shaped substantially parallel flow channels extending and enabling flow communication between a radially outer orifice and a radially inner orifice, characterized in that the centre body comprises a wall body with an first conduit at the inner surface of the wall body being in fluid connection to the first flow channel, and an second conduit formed at the outer surface of the wall body and being in fluid connection to the second flow channel.

In an embodiment the first conduit and second conduit extend in parallel along a length direction of the centre body.

In an embodiment the first conduit and second conduit extend essentially concentric along a length direction of the centre body.

Openings may be formed in the wall body forming fluidic connecting between the first conduit and the first flow channel, said openings being sealed from the second flow channel.

One of the sheets may have an end section connected to an outer part of the centre body seen in the direction of the circumference.

The outer surface of the wall body may be formed with features projecting out from the outer surface of the wall body, said first features formed flow passages. The features may be formed as a number disc shaped elements positioned in a length direction of the centre body.

In an embodiment a first of said sheets has an end-section connected to a first section of at least some of the features, said section being less that the full circumference, said second conduit at least partly being defined by the end-section of said first sheet, the outer of said wall body and said flow passages.

In an embodiment a second of said sheet has an end-section connected to a second section of at least some of the features, said end-section being less that the full circumference, said second conduit at least partly being defined by the end-section of said second sheet, the outer of said wall body and flow passages.

A sealing feature may be positioned between said wall body and second sheet extending in a length direction relative to the centre body, said sealing feature preventing fluid contact between the first and second flow channels. The sealing feature may be positioned in the area of said openings and formed with an internal cavity formed to direct fluid between the first conduit and first flow channel.

In an embodiment the flow passages forms part of the first flow conduit and/or second flow conduit.

DETAILED DESCRIPTION

It should be understood the detailed description and specific examples, while indicating embodiments of the invention, are given by way of illustration only, since various changes and modifications within the spirit and scope of the invention will become apparent to those skilled in the art from the detailed description.

Figure 1:
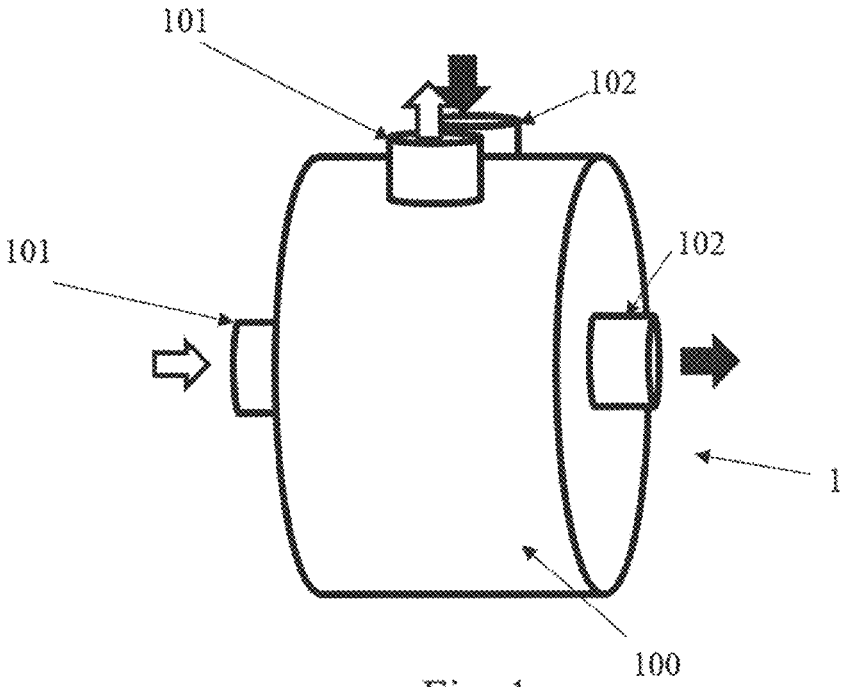
FIG. 1 General illustration of a spiral heat exchanger seen from the outside.

FIG. 1 is a general example showing the outside of a spiral heat exchanger (1) having an outer shell (100). Two sets of inlet and outlet port connections (101, 102) to connect the heat exchanger (1) to fluid pipes for a first and second fluid. The white and black arrows illustrate such inlet and outlet of two fluids, but the directions could be reversed etc, port connections (101, 102) positioned differently etc.

Inside the heat exchanger (1) is a structure forming two separate flow channels (5, 6), where heat is being transferred between them.

Figure 2:
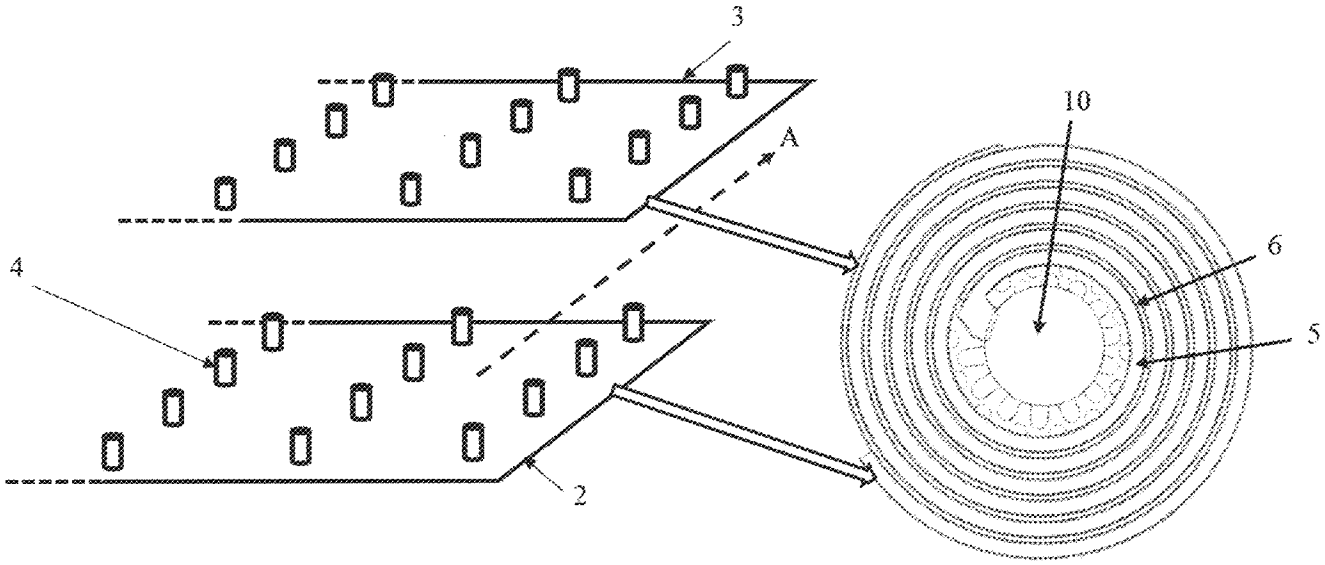
FIG. 2 Illustration of a spiral heat exchanger formed of two sheets spiralling around a centre body according to the present invention.

FIG. 2 illustrate one example of a construction of a spiral heat exchanger (1). A first (2) sheet and a second sheet (3) is formed with separating elements (4) projecting out from the one surface, where the other surface may be flat, or plane. The separating elements (4) may have any suitable form, such as struts extending from the surface of the sheet, they may be fixed to the sheet (2, 3) e.g. by welding or brazing, or they may be shaped from the sheet (2, 3) material.

The first (2) and second (3) sheets then are positioned spiralling around a common central axis (A) extending in a length direction. The two sheets (2, 3) thus extends along a spiral-shaped path around said central axis (A) and through the separating elements (4) a first (5) and a second (6) spiral-shaped substantially parallel flow channels (5, 6) are formed for respectively the first and second fluids, extending and enabling flow communication between a radially outer orifice and a radially inner orifice being in fluid communication with the either an inlet or outlet of each set of port connections (101, 102). Respectively the radially inner orifice and outer orifice of the first flow channel (5) thus is in fluid communication to an inlet and outlet of the first set of port connections (101), and second flow channel (6) thus is in fluid communication to an inlet and outlet (102) of the s set of port connections (102).

Figure 3:
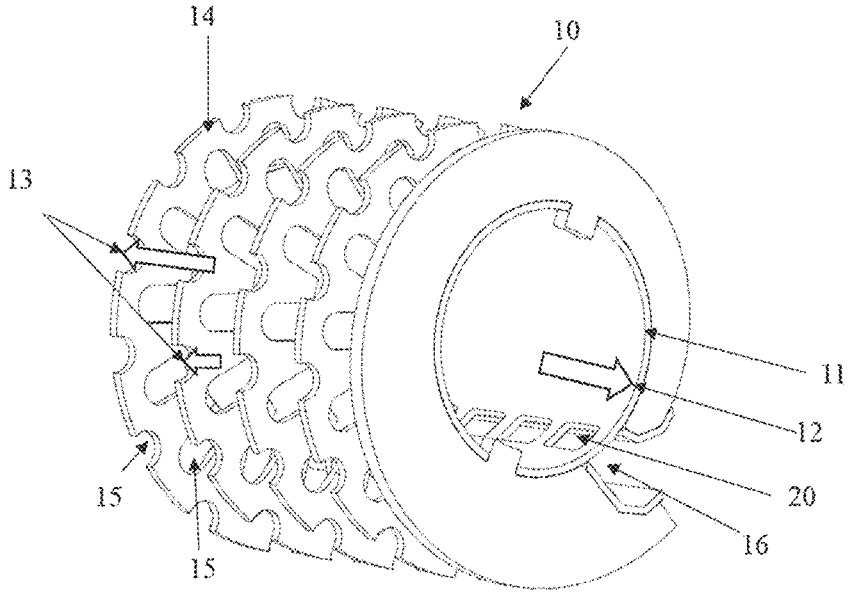
FIG. 3 Illustration of an embodiment of the centre body according to an embodiment of the present invention.
Figure 4:
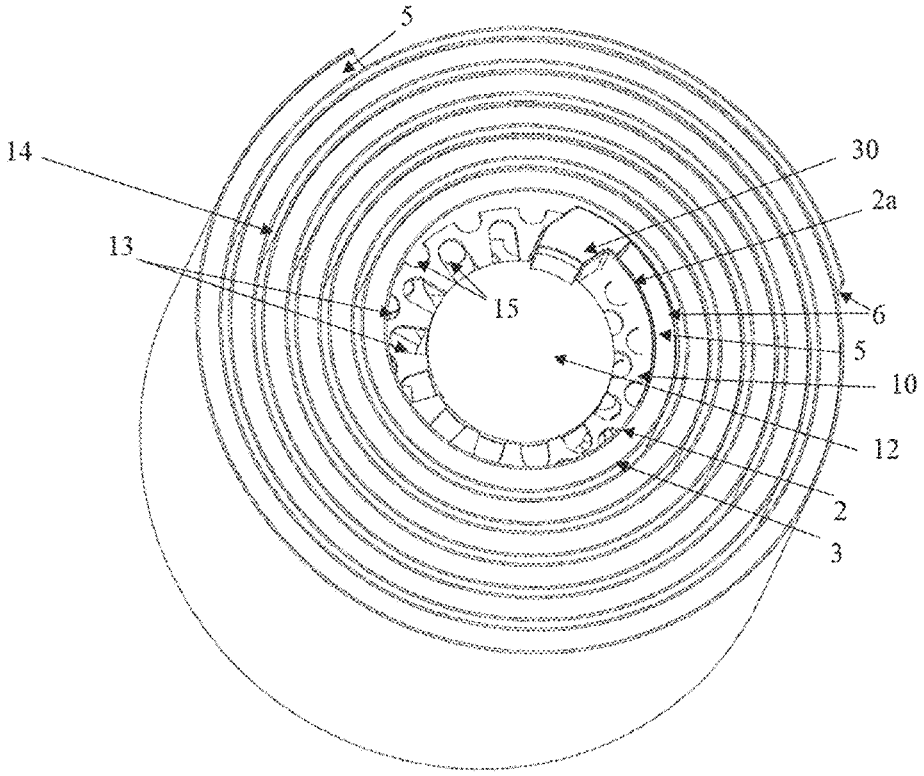
FIG. 4 Illustration of a spiral heat exchanger formed of two sheets spiralling around a centre body according to the present invention.

The present invention introduces a centre body (10) (see FIG. 3) to be positioned at the central axis (A) and extending in the same length direction. The two sheets (2, 3) thus are to be positioned spiralling around said centre body (10) which comprises a wall body (11) with an first conduit (12) at the inner surface of the wall body (11) being in fluid connection (20) to the first flow channel (5), and an second conduit (13) formed at the outer surface of the wall body (11) and being in fluid connection to the second flow channel (6).

In the illustrated embodiment of the centre body (10) the first conduit (1) and second conduit (2) extend in parallel along a length direction of the centre body (10). The first conduit (12) is formed by the internal cavity formed within the wall body (11), which in the illustrated embodiment is tube formed, or cylindrical. Openings (20) are formed in the wall body (11) adapted to form fluidic communication between the radially inner orifice of the first flow channel (5) and the first conduit (12). The openings (20) are sealed (30) from the second flow channel (6).

In the illustrated embodiment the first conduit (12) and second conduit (13) extend essentially concentric along a length direction of the centre body (10). In a more general version, the second conduit (13) circumference the first conduit (12).

Other embodiments could include there being a plural of first conduits (12) and/or a plural of second conduits (13), where the second conduit(s) (13) is/are positioned to circumference the first conduit(s) (12).

The outer surface of the wall body (11) is formed with features (14) projecting out from the outer surface where flow passages (15) are formed in the features (14). This flow passages (15) could be recesses or openings. The features (14) could be connected to the outer surface of the wall body (11) or could be formed as an integral part thereof. The flow passages (15) enables a fluid flow along the length of the outer surface of the wall body (11), the features (14) thus being porous rather than forming barriers.

In the illustrated embodiment the features (14) are a number part-disc shaped elements positioned in the length direction of the centre body (10).

The first of said sheets (2) may have an end-section (2*a*) connected to a first section of at least some of the features (14), corresponding to centre body (10), said first section fully circumference the centre body (10) or being less than the full circumference. The second conduit (13) then either fully or partly being defined by the end-section (2*a*) of said first sheet (2), the outer of said wall body (11) and said flow passages (15).

The second of said sheets (3) may have an end-section connected to a second section of at least some of the features (14), corresponding to centre body (10), said second section fully circumference the centre body (10) or being less than the full circumference. The second conduit (13) then either fully or partly being defined by the end-section of said third sheet (3), the outer of said wall body (11) and said flow passages (15).

In one embodiment the connection of the first end-section (2*a*) and second end-section fully circumference the centre body, corresponding to the full circumference of the features (14). Together they thus form an inner 'tube' like shape at the inner of the combined spiralling sheets (2, 3), the centre body (10) being positioned within the 'tube' with the external surfaces of the features (14) contacting the inner wall of the 'tube', corresponding the first end-section (2*a*) and second end-section. This defines the second conduit (13) extending in the length direction of the other surface of the wall body (10). The inner radial orifice of the second flow channel (6) is open to the second conduit (13) where the second sheet (3) ends.

The inner radial orifice of the first flow channel (5) in the same manner is open to the inner of the spiralling sheets (2, 3) where the first sheet (2) ends, this to the second conduit (13), just as the openings (20) would form fluid contact between the first conduit (12) and second conduit (13), unless separated in some manner. In the illustrated embodiment a sealing feature (30) is positioned between said wall body (11) and second sheet (3) extending in a length direction relative to the centre body (10), said sealing feature (30) preventing fluid contact between the first (5) and second (6) flow channels.

In the illustrated embodiment the sealing feature (30) is positioned in the area of said openings (20) and is formed with an internal cavity, or channel, (not seen in the figures) formed to direct fluid between the first conduit (12) and first flow channel (5). This ensures there is no fluid communication between the respective inner radial orifice of the first flow channel (5) (mounding into the inner of the internal cavity of the sealing feature (30), and the inner radial orifice of the second flow channel (6) (mounding into the second conduit (13)). The sealing feature (30) further ensures there to be no fluid communication between the first conduit (12) and second conduit (13) through openings (20).

In one embodiment the features (14) are formed with a shape or recess (16) adapted to accommodate the sealing feature (30), hence the features illustrated being part discs (14). In another embodiment the features (14) fully circumference the wall body (11) (such as being full discs), the sealing features (30) being formed to be positioned between the features (14), possible even being formed as a plural of sealing features (30).

The centre body (10) respectively at one end may comprise a sealing to the inner fluid conduit (12) which is open and connected to a first set inlet or outlet port connection (101) at the other end.

The centre body (10) respectively at one end may comprise a sealing to the outer fluid conduit (13) which is open and connected to a second set inlet or outlet port connection (102) at the other end.

In one embodiment the centre body (10) is formed by connecting a plural of subparts. In another, or related, embodiment, the whole of the centre body (10) or sub-parts thereof are formed as a single part, possible with features like the recesses or openings (15) formed by laser cutting, or simply by 3D printing.

In an embodiment either one or both of the first flow conduit (12) and/or second flow conduit (13) is/are formed at the outside of the wall body (11), where the flow passages (15) forms part of respectively first flow conduit (12) and/or second flow conduit (13). In the embodiment where both first (12) and second (13) flow conduits are formed at the outside of the wall body (11), some separating element are positioned to seal the two flow paths from each other. The openings (20) thus may be positioned in this separating element rather than in the wall body (11).

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A spiral heat exchanger including at least two sheets extending along a spiral-shaped path around a common centre body and separated to form at least a first and a second spiral-shaped substantially parallel flow channels extending and enabling flow communication between a radially outer orifice and a radially inner orifice, wherein the centre body comprises a wall body with a first conduit at an inner surface of the wall body being in fluid connection with the first flow channel, and a second conduit formed at an outer surface of the wall body and being in fluid connection with the second flow channel, wherein the first conduit and the second conduit extend in parallel along a length direction of the centre body, and wherein the first conduit and the second conduit extend essentially concentric along the length direction of the centre body.

2. The spiral heat exchanger according to claim 1, where openings are formed in the wall body forming fluidic connections between the first conduit and the first flow channel, said openings being sealed from the second flow channel.

3. The spiral heat exchanger according to claim 2, wherein one of said sheets has an end section connected to an outer part of the centre body seen in the direction of the circumference of the centre body.

4. The spiral heat exchanger according to claim 2, where the outer surface of the wall body is formed with features projecting out from the outer surface of the wall body, said features forming flow passages.

5. The spiral heat exchanger according to claim 1, wherein one of said sheets has an end section connected to an outer part of the centre body seen in the direction of the circumference of the centre body.

6. The spiral heat exchanger according to claim 1, where the outer surface of the wall body is formed with features projecting out from the outer surface of the wall body, said features forming flow passages.

7. The spiral heat exchanger according to claim 6, where the flow passages form part of the first flow conduit and/or the second flow conduit.

8. The spiral heat exchanger according to claim 1, wherein a seal is positioned between said wall body and said second sheet extending in a length direction relative to the centre body, said seal preventing fluid contact between the first and second flow channels.

9. A spiral heat exchanger including at least two sheets extending along a spiral-shaped path around a common centre body and separated to form at least a first and a second spiral-shaped substantially parallel flow channels extending and enabling flow communication between a radially outer orifice and a radially inner orifice, wherein the centre body comprises a wall body with a first conduit at an inner surface of the wall body being in fluid connection with the first flow channel, and a second conduit formed at an outer surface of the wall body and being in fluid connection with the second flow channel, wherein the outer surface of the wall body is formed with features projecting out from the outer surface of the wall body, said features forming flow passages, wherein said features are a number of disc shaped elements positioned in a length direction of the centre body.

10. A spiral heat exchanger including at least two sheets extending along a spiral-shaped path around a common centre body and separated to form at least a first and a second spiral-shaped substantially parallel flow channels extending and enabling flow communication between a radially outer orifice and a radially inner orifice, wherein the centre body comprises a wall body with a first conduit at an inner surface of the wall body being in fluid connection with the first flow channel, and a second conduit formed at an outer surface of the wall body and being in fluid connection with the second flow channel, wherein the outer surface of the wall body is formed with features projecting out from the outer surface of the wall body, said features forming flow passages, wherein a first of said sheets has an end-section connected to a first section of at least some of the features, said end-section being less than the full circumference of the features, said second conduit at least partly being defined by the end-section of said first sheet, the outer surface of said wall body and said flow passages.

11. A spiral heat exchanger including at least two sheets extending along a spiral-shaped path around a common centre body and separated to form at least a first and a second spiral-shaped substantially parallel flow channels extending and enabling flow communication between a radially outer orifice and a radially inner orifice, wherein the centre body comprises a wall body with a first conduit at an inner surface of the wall body being in fluid connection with the first flow channel, and a second conduit formed at an outer surface of the wall body and being in fluid connection with the second flow channel, wherein the outer surface of the wall body is formed with features projecting out from the outer surface of the wall body, said features forming flow passages, wherein a second of said sheets has an end-section connected to a second section of at least some of the features, said end-section being less than the full circumference of the features, said second conduit at least partly being defined by the end-section of said second sheet, the outer surface of said wall body and the flow passages.

12. A spiral heat exchanger including at least two sheets extending along a spiral-shaped path around a common centre body and separated to form at least a first and a second spiral-shaped substantially parallel flow channels extending and enabling flow communication between a radially outer orifice and a radially inner orifice, wherein the centre body comprises a wall body with a first conduit at an inner surface of the wall body being in fluid connection with the first flow channel, and a second conduit formed at an outer surface of the wall body and being in fluid connection with the second flow channel, wherein a seal is positioned between said wall body and said second sheet extending in a length direction relative to the centre body, said seal preventing fluid contact between the first and second flow channels, wherein said seal is positioned in the area of openings and is formed with an internal cavity formed to direct fluid between the first conduit and the first flow channel.

* * * * *